US009500056B2

(12) United States Patent
Scott et al.

(10) Patent No.: US 9,500,056 B2
(45) Date of Patent: Nov. 22, 2016

(54) WEIGHT DOWN COLLET FOR A DOWNHOLE SERVICE TOOL

(71) Applicant: Halliburton Energy Services, Inc., Houston, TX (US)

(72) Inventors: Keith Wayne Scott, Lavon, TX (US); Thomas Jules Frosell, Irving, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/759,727

(22) PCT Filed: Sep. 15, 2014

(86) PCT No.: PCT/US2014/055632
§ 371 (c)(1),
(2) Date: Jul. 8, 2015

(87) PCT Pub. No.: WO2016/043702
PCT Pub. Date: Mar. 24, 2016

(65) Prior Publication Data

US 2016/0273291 A1 Sep. 22, 2016

(51) Int. Cl.

| | |
|---|---|
| ***E21B 23/03*** | (2006.01) |
| *E21B 43/04* | (2006.01) |
| *E21B 43/08* | (2006.01) |

(52) U.S. Cl.
CPC ..... *E21B 23/03* (2013.01); *E21B 43/04* (2013.01); *E21B 43/08* (2013.01)

(58) Field of Classification Search
CPC ..... E21B 23/03; E21B 43/04; E21B 43/08
See application file for complete search history.

(56) References Cited

U.S. PATENT DOCUMENTS

| | | | |
|---|---|---|---|
| 4,722,392 | A | 2/1988 | Proctor et al. |
| 5,921,318 | A | 7/1999 | Ross |
| 7,997,344 | B2 | 8/2011 | Corbett |
| 8,096,356 | B2 | 1/2012 | Guignard et al. |
| 2002/0117301 | A1 | 8/2002 | Womble |
| 2006/0225878 | A1 | 10/2006 | Coronado |
| 2009/0065193 | A1 | 3/2009 | Corbett |

FOREIGN PATENT DOCUMENTS

| | | | |
|---|---|---|---|
| CN | 101432501 | A | 5/2009 |
| WO | 2014022105 | A1 | 2/2014 |

OTHER PUBLICATIONS

International Search Report and Written Opinion for PCT/US2014/055632 dated May 29, 2015.

*Primary Examiner* — David Andrews
(74) *Attorney, Agent, or Firm* — McDermott Will and Emery LLP; Scott Richardson

(57) ABSTRACT

A weight down collet includes a mandrel that provides an outer diameter feature and a shoulder, and a collet sleeve assembly movably disposed about the mandrel. The collet sleeve assembly includes a body, a primary collet provided on the body and defining an upper detent and a lower detent having a gap defined therebetween, and a secondary collet provided on the body and axially spaced from the primary collet. The upper and lower detents extend radially outward from the body and are engageable with one or more restrictions provided on an inner wall of a completion string, and the secondary collet defines an inner detent that extends radially inward and is engageable with the shoulder. The collet sleeve assembly is movable between an unsupported position, where the primary collet is radially unsupported, and a supported position, where the primary collet is radially supported on the outer diameter feature.

19 Claims, 3 Drawing Sheets

WEIGHT DOWN COLLET FOR A DOWNHOLE SERVICE TOOL

BACKGROUND

The present disclosure is related to downhole tools used in the oil and gas industry and, more particularly, to a weight down collet that allows a service tool to set weight down only on a desired indicator coupling within a completion string.

In the oil and gas industry, particulate materials such as sand and other wellbore debris are often produced to the surface during the extraction of hydrocarbons from a well traversing an unconsolidated or loosely consolidated subterranean formation. Producing such particulate matter can cause abrasive wear to components within the well, such as tubing, pumps, and valves, and can sometimes partially or fully clog the well, thereby creating the need for an expensive workover operation. Also, if the particulate matter is produced to the surface, it must be removed from the extracted hydrocarbons by various processing equipment at the surface.

In order to prevent the production of particulate materials to the surface, production intervals in the well are often gravel packed, which helps filter out sand and other particulates from the production fluid entering the wellbore. The gravel pack is formed using a gravel pack completion string that is lowered into the well to a position proximate the desired production interval. A service tool is then positioned within the completion string and a gravel slurry is flowed downhole to the service tool where a carrier fluid is separated from the gravel slurry and gravel is left in the production interval as gravel pack. The carrier fluid then reenters the service tool through one or more sand screens associated with the completion string and is returned upwardly through a washpipe section of the service tool. The return flow is directed upwardly through a central passage of the washpipe and then diverted outwardly to an annular flow path through a crossover port.

In some applications, the service tool is used to treat multiple production intervals in a single trip downhole. To accomplish this, a weight down collet associated with the service tool is required to locate and rest on an indicator coupling provided on the inner wall of the completion string. Upon properly locating the desired indicator coupling, the service tool will be aligned with the desired production interval so that downhole operations can be undertaken. While locating the indicator coupling, however, the weight down collet often enters and passes through one or more a seal bores. The friction generated between the weight down collet and the seal bore can prematurely cycle the weight down collet to a weight down position. In such scenarios, the service tool is supported enough to lock up, but is not fully supported. As a result, the service tool can be damaged or the weight down collet can fail.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to downhole tools used in the oil and gas industry and, more particularly, to a weight down collet that allows a service tool to set weight down only on a desired indicator coupling within a completion string.

The embodiments described herein provide a weight down collet that includes a primary collet and a secondary collet movably disposed about a mandrel. As the weight down collet seeks a desired indicator coupling provided within a completion string, the secondary collet may prove useful in helping the primary collet locate the desired indicator coupling instead of incorrectly locating on a seal bore and prematurely moving the weight down collet to a fully supported position. As described herein, this may be accomplished by designing the primary and secondary collets with snap values that allow the secondary collet to engage an outer diameter feature of the mandrel upon engaging a seal bore, which prevents the weight down collet from moving to the fully supported position. The snap value of the secondary collet, however, may be overcome when the primary collet encounters the desired indicator coupling, thereby allowing the weight down collet to move to the fully supported position.

Figure 1:
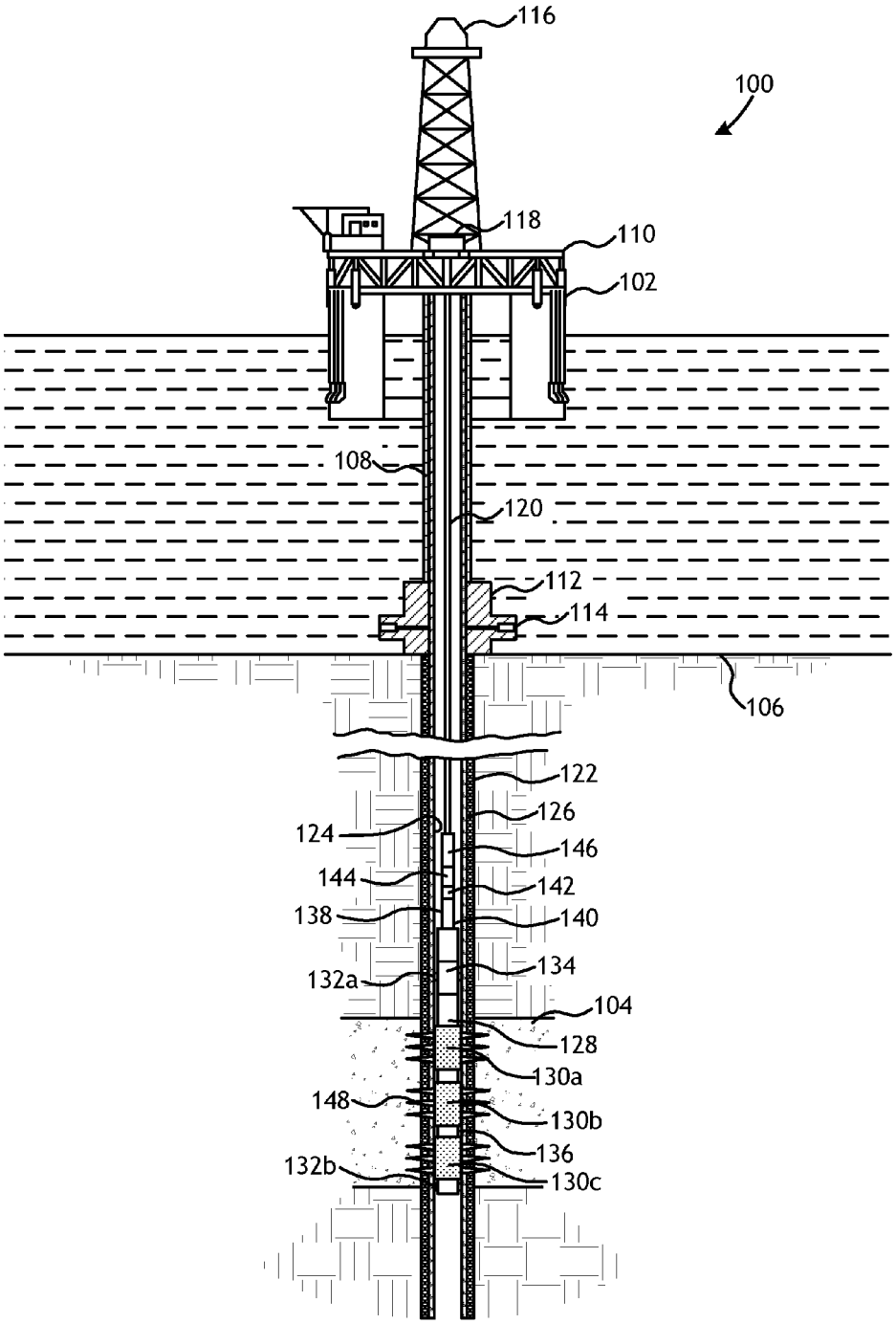
FIG. 1 is a well system that employs one or more principles of the present disclosure.

FIG. 1 is a well system 100 that may employ one or more principles of the present disclosure, according to one or more embodiments. As illustrated, the well system 100 may include an offshore oil and gas platform 102 located above a submerged hydrocarbon-bearing formation 104 located below the sea floor 106. A subsea conduit or riser 108 extends from a deck 110 of the platform 102 to a wellhead installation 112 that may include one or more blowout preventers 114. The platform 102 may include a derrick 116 and a hoisting apparatus 118 for raising and lowering pipe strings, such as a work string 120. While the system 100 depicts the use of the offshore platform 102, it will be appreciated that the principles of the present disclosure are equally applicable to other types of oil and gas installations, such as land-based drilling and production rigs, service rigs, wellhead installations, and other oil and gas rigs or installations located at any geographical location.

A wellbore 122 extends from the wellhead installation 112 and through various earth strata, including the formation 104. In some embodiments, casing 124 may be cemented within at least a portion of the wellbore 122 using cement 126. In other embodiments, the casing 124 may be omitted and portions of the wellbore 122 may be considered "open-hole" portions. A completion string 128 is depicted in FIG. 1 as being installed within the wellbore 122 and may include one or more sand screens 130*a*, 130*b*, and 130*c* positioned adjacent the formation 104 between packers 132*a* and 132*b*. In some embodiments, the upper packer 132*a* may be part of or adjacent a circulating valve 134.

When it is desired to gravel pack an annulus 136 defined between the sand control screens 130*a-c* and the walls of the wellbore 122, the work string 120 may be lowered through the casing 124 and at least partially into the completion string 128. The work string 120 may include a service tool 138 having a weight down collet 140, a reverse-out valve 142, a crossover tool 144, a setting tool 146, and other downhole tools known to those skilled in the art. According to embodiments of the present disclosure, the weight down collet 140 may be used to help locate the service tool 138 at a desired indicator coupling within the completion string 128 instead of incorrectly locating the service tool 138 on a seal bore (not shown). Once properly located within the completion string 128, the service tool 138 may then be operated through various axial positions to undertake, for example, a gravel packing operation within the annulus 136. As illustrated, portions of the casing 124 and the wellbore 122 have been perforated to provide one or more perforations 148 that extend a distance into the surrounding formation 104 and provide fluid conductivity between the formation 104 and the annulus 136.

Even though FIG. 1 depicts a vertical well, it will be appreciated by those skilled in the art that the principles of the present disclosure are equally well suited for use in deviated wells, inclined wells, or horizontal wells. In addition, even though FIG. 1 depicts a cased wellbore 122, those skilled in the art will readily appreciate that the principles of the present disclosure are equally well suited for use in open-hole completions. Additionally, even though FIG. 1 has been described with reference to a gravel packing operation, including a squeeze (i.e., fracking) operation, it should be noted by one skilled in the art that the principles of the present disclosure are equally well-suited for use in a variety of treatment operations where it is desirable to selectively allow or prevent circulation of fluids through the service tool 138.

Figure 2:
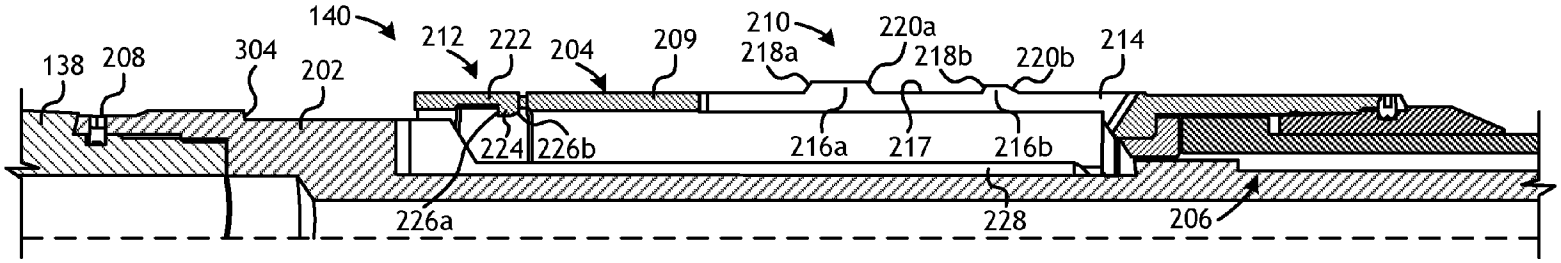
FIG. 2 is an enlarged cross-sectional side view of an embodiment of the weight down collet of FIG. 1.

FIG. 2 is a cross-sectional side view of an embodiment of the weight down collet 140 of FIG. 1. As illustrated, the weight down collet 140 may include a mandrel 202, a collet sleeve assembly 204 movably disposed about the mandrel 202, and a J-slot mechanism 206. The mandrel 202 may be operably coupled to the service tool 138 (FIG. 1) at its upper end (i.e., to the left in FIG. 2) and may, therefore, form an integral part or section thereof. In some embodiments, the mandrel 202 may be threaded to the service tool 138, but could alternatively be mechanically fastened thereto using one or more mechanical fasteners 208, such as bolts, pins, snap rings, etc., without departing from the scope of the disclosure.

The collet sleeve assembly 204 may include a body 209 that defines and otherwise provides a primary collet 210 and a secondary collet 212 axially spaced from each other along the length of the body 209. The primary collet 210 may include a plurality of collet fingers 214 extending axially from the body 209. Each collet finger 214 may provide or otherwise have defined thereon an upper detent 216*a* and a lower detent 216*b* axially offset from each other such that a gap 217 is defined therebetween. As will be appreciated, the axial length or size of the gap 217 may vary, without departing from the scope of the disclosure.

As illustrated, the upper and lower detents 216*a,b* extend radially outward from the outer surface of the collet fingers 214 and each of the upper and lower detents 216*a,b* may have an uphole end 218 and a downhole end 220. More particularly, the upper detent 216*a* may provide an uphole end 218*a* and a downhole end 220*a*, while the lower detent 216*b* may provide an uphole end 218*b* and a downhole end 220*b*.

As illustrated, the uphole and downhole ends 218, 220 may each have an angled profile. The severity (i.e., steepness or shallowness) of the angled profiles may correspond to a snap value for the upper and lower detents 216*a,b* upon encountering a restriction within the completion string 128 (FIG. 1). As used herein, the phrase "snap value" refers to the amount of force required to push or force a detent (e.g., the upper and lower detents 216*a,b*) through a restriction or over a radial obstruction, such as a radial shoulder or the like. For instance, steeper angled profiles will tend to exhibit a larger snap value than angled profiles that are more shallow and will therefore require more force to be pushed through a given restriction. In the illustrated embodiment, the uphole ends 218*a,b* of the upper and lower detents 216*a,b* exhibit an angled profile that is substantially similar and about 45° from horizontal. As a result, the snap value of the upper and lower detents 216*a,b* may be substantially similar upon encountering a given restriction while the collet sleeve assembly 204 moves in the uphole direction (i.e., to the left in FIG. 2). On the other hand, the angled profile of the downhole end 220*a* of the upper detent 216*a* is steeper than the angled profile of the downhole end 220*b* of the lower detent 216*b*. As a result, the snap value of the upper detent 216*a* may be greater than the snap value of the lower detent 216*b* upon encountering a given restriction while the collet sleeve assembly 204 moves in the downhole direction (i.e., to the right in FIG. 2).

The secondary collet 212 may be axially offset from the primary collet 210 in the uphole direction. Similar to the primary collet 210, the secondary collet 212 may include a plurality of axially extending collet fingers 222. Each collet finger 222 may provide or otherwise have defined thereon an inner detent 224 that extends radially inward from the inner surface of the collet fingers 222. The inner detent 224 may define an uphole end 226*a* and a downhole end 226*b*. As illustrated, the uphole and downhole ends 226*a,b* of the inner detent 224 may each have an angled profile that corresponds to the snap value of the inner detent 224 while moving in the uphole or downhole directions, respectively. In the illustrated embodiment, for example, the angled profile of the uphole end 226*a* is steeper than the angled profile of the downhole end 226*b*. Accordingly, the snap value of the inner detent 224 is greater as the collet sleeve assembly 204 moves in the uphole direction as opposed to moving in the downhole direction.

The J-slot mechanism 206 allows the weight down collet 140 to cycle between supported and unsupported positions, and thereby allow the service tool 138 to be fully supported by the completion string 128 (FIG. 1) such that the weight of the work string 120 (FIG. 1) may be placed on a restriction. The J-slot mechanism 206 may include one or more lugs (not shown in FIG. 2) that are able to translate within a J-slot profile 228 defined at least partially by the mandrel 202. Briefly, the J-slot profile 228 provides a switchback-type shape that guides the lugs as the weight down collet 140 cycles between the supported and unsupported positions. In the unsupported position, as shown in FIG. 2, one or more dogs (not shown) defined on the mandrel 202 may be configured to engage an inner diameter feature (not shown) on the J-slot profile 228, and thereby prevent the mandrel 202 from moving downhole with respect to the weight down collet 204. Cycling the weight down collet 140 may include rotating and moving the weight down collet 140 up and down with respect to the completion string 128. When the weight down collet 140 is in the unsupported position, the primary collet 210 is not radially supported and, therefore, able to pass through restrictions provided within the completion string 128 as the service tool 138 moves downhole. In the supported position, however, the primary collet 210 becomes radially supported by the mandrel 202 and prevents the weight down collet 140 from bypassing a given restriction provided within the completion string 128, thereby allowing the weight of the work string 120 to be placed securely on the restriction.

Figure 3:
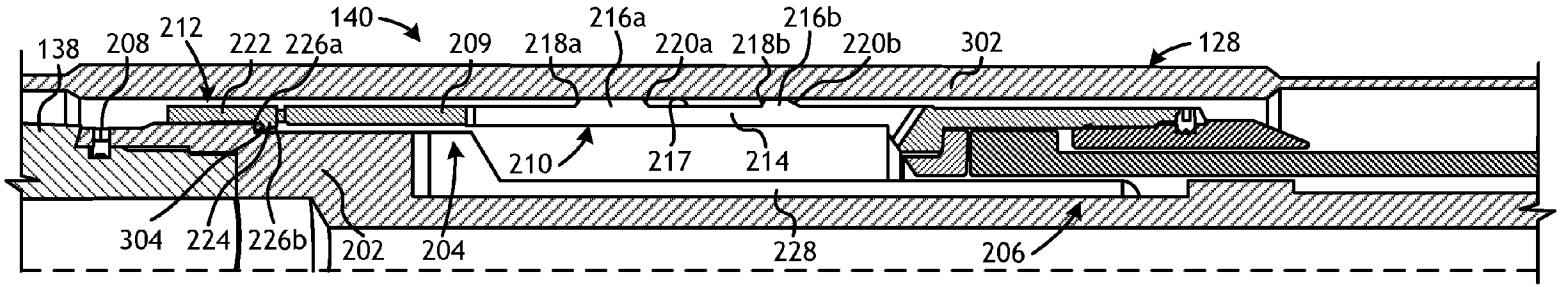
FIG. 3 is a cross-sectional side view of the weight down collet of FIG. 2 as engaged with a seal bore restriction.

Referring to FIG. 3, illustrated is a cross-sectional side view of the weight down collet 140 as engaged with a restriction provided within the completion string 128, according to one or more embodiments. As used herein the term "restriction" refers to any portion of the completion string 128 that exhibits a smaller inner diameter than the outer diameter of the primary collet 210 (i.e., the outer diameter of the upper and lower detents 216*a,b*). In FIG. 3, the restriction is shown as a seal bore 302 provided on the inner radial surface of the completion string 128. As described below, however, the restriction may also be an indicator coupling (not shown) provided within the completion string 128. As will be appreciated, other types of restrictions may equally be encountered by the weight down collet 140, without departing from the scope of the disclosure.

In FIG. 3, as the service tool 138 moves in the downhole direction (i.e., to the right in FIG. 3) with respect to the completion string 128, the primary collet 210 may eventually encounter and engage the seal bore 302. More particularly, the downhole end 220*b* of the lower detent 216*b* of the primary collet 210 may encounter and engage the seal bore 302. Since the inner diameter of the seal bore 302 is smaller than the outer diameter of the primary collet 210, engaging the downhole end 220*b* of the lower detent 216*b* on the seal bore 302 may apply a force that moves the collet sleeve assembly 204 upwards (i.e., to the left in FIG. 3) with respect to the mandrel 202. The collet sleeve assembly 204 may move upwards until the secondary collet 212 engages a shoulder 304 (best seen in FIG. 2) defined on the mandrel 202. The outer diameter of the shoulder 304 may be greater than the inner diameter of the secondary collet 212. As a result, the uphole end 226*a* of the inner detent 224 may engage the shoulder 304 and stop the movement of the collet sleeve assembly 204 relative to the mandrel 202.

As illustrated, the angled profile of the uphole end 226*a* of the inner detent 224 is steeper than the angled profile of the downhole end 220*b* of the lower detent 216*b*. For instance, in some embodiments, the angled profile of the uphole end 226*a* of the inner detent 224 may exhibit an angle ranging between about 45° to about 60° from horizontal (with respect to the body 209), and the angled profile of the downhole end 220*b* of the lower detent 216*b* may exhibit an angle ranging between about 15° to about 30° from horizontal. As a result, the snap value of the inner detent 224 of the secondary collet 212 as engaged on the shoulder 304 may be greater than the snap value of the lower detent 216*b* of the primary collet 210 as the weight down collet 140 engages the seal bore 302 while moving in the downhole direction. Accordingly, with the secondary collet 212 engaged on the shoulder 304, continued movement of the service tool 138 in the downhole direction with respect to the completion string 128 may overcome the snap value of the lower detent 216*b* and thereby enable the service tool 138 to enter the seal bore 302 without moving the weight down collet 140 to the fully supported position. Rather, the collet sleeve assembly 204 remains engaged at the shoulder 304 via the secondary collet 212 as the lower detent 216*b* slidingly engages the seal bore 302.

In the embodiment of FIG. 3, the seal bore 302 is axially longer than the gap 217 defined between the upper and lower detents 216*a,b* of the primary collet 210. As a result, the upper detent 216*a* may be able to enter the seal bore 302 with minimal force without moving the weight down collet 140 to the supported position. More particularly, since the upper and lower detents 216*a,b* are defined on the same collet finger 214 and the lower detent 216*b* is able to pass into the seal bore 302, the upper detent 216*a* may also be able to pass into the seal bore 302 since the corresponding collet finger 214 is already collapsed by interaction with the seal bore 302 via the lower detent 216*b*. Moreover, the snap value of the secondary collet 212 as engaged on the shoulder 304 may be greater than the friction generated through engagement between the primary collet 210 and the seal bore 302. As a result, the weight down collet 140 remains in the unsupported position and the service tool 138 will not locate on this restriction (i.e., the seal bore 302), but will instead move through the seal bore 302 and further downhole.

Figure 4A:
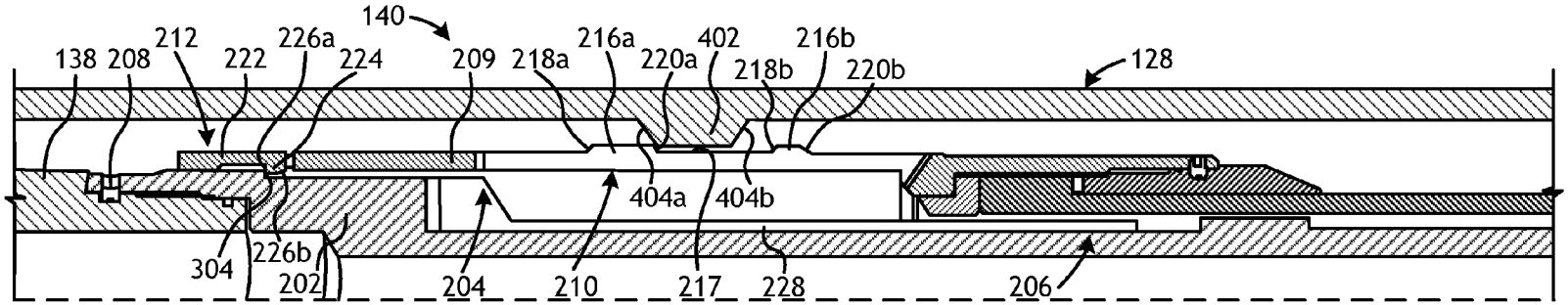
FIGS. 4A and 4B are progressive cross-sectional side views of the weight down collet of FIG. 2 as engaged with an indicator collet restriction.
Figure 4B:
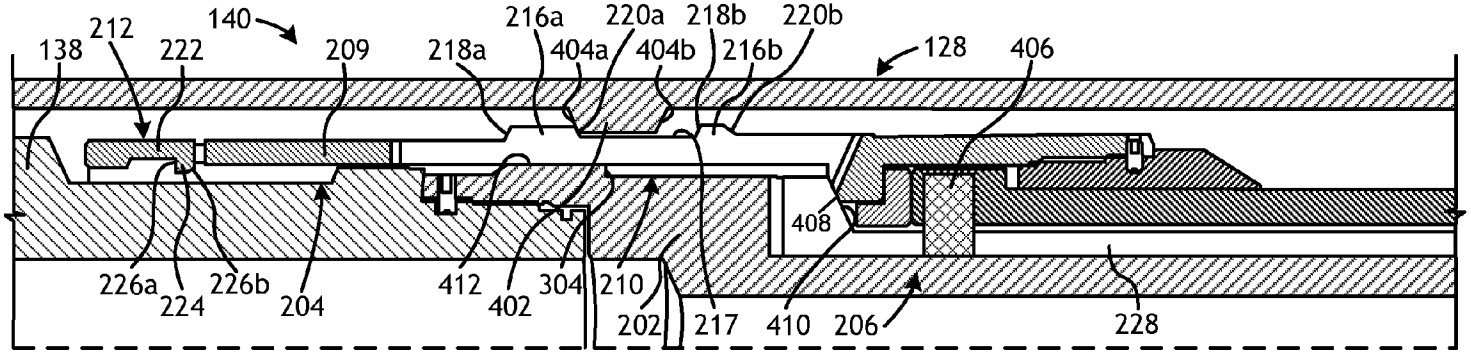

Referring now to FIGS. 4A and 4B, illustrated are cross-sectional side views of the weight down collet 140 as engaged with another restriction provided within the completion string 128, according to one or more embodiments. More particularly, the restriction in FIGS. 4A and 4B is an indicator coupling 402, which may be axially shorter than the seal bore 302 and otherwise able to enter the gap 217 between the upper and lower detents 216*a,b* of the primary collet 210. As illustrated, the indicator coupling 402 may provide an uphole end 404*a* and a downhole end 404*b*. The uphole and downhole ends 404*a,b* of the indicator coupling 402 may each exhibit an angled profile engageable with the uphole and downhole ends 218*a,b* and 220*a,b*, respectively, of the upper and lower detents 216*a,b*. In the illustrated embodiment, for example, the angled profile of the uphole and downhole ends 404*a,b* of the indicator coupling may be about 45°, but may alternatively be any other angle, without departing from the scope of the disclosure.

As the service tool 138 moves in the downhole direction with respect to the completion string 128, the primary collet 210 eventually encounters the indicator coupling 402. More particularly, the downhole end 220*b* of the lower detent 216*b* of the primary collet 210 encounters and engages the uphole end 404*a* of the indicator coupling 402 and thereby applies a force on the collet sleeve assembly 204 that moves the collet sleeve assembly 204 upwards with respect to the mandrel 202. As with the embodiment of FIG. 3, the collet sleeve assembly 204 may move upwards until the uphole end 226*a* of the inner detent 224 of the secondary collet 212 engages the shoulder 304 and stops the relative movement of the collet sleeve assembly 204 with respect to the mandrel 202. Since the angled profile of the uphole end 226*a* of the inner detent 224 is steeper than the angled profile of the downhole end 220*b* of the lower detent 216*b*, as discussed above, the snap value of the lower detent 216*b* may be overcome as the service tool 138 continues movement in the downhole direction and the indicator coupling 402 is therefore able to bypass the lower detent 216*b*. Once past the lower detent 216, the indicator coupling 402 may be able to enter the gap 217 between the upper and lower detents 216*a,b*.

Once the indicator coupling 402 enters the gap 217, further downhole movement of the service tool 138 with respect to the completion string 128 may bring the downhole end 220*a* of the upper detent 216*a* of the primary collet 210 into engagement with the uphole end 404*a* of the indicator coupling 402, as shown in FIG. 4A. In some embodiments, the snap value of the engagement between the downhole end 220*a* of the upper detent 216*a* and the uphole end 404*a* of the indicator coupling 402 may be greater than the snap value of the engagement between the uphole end 226*a* of the inner detent 224 of the secondary collet 212 and the shoulder 304. As a result, further downhole movement of the service tool 138 with respect to the completion string 128 may overcome the snap value engagement between the inner detent 224 and the shoulder 304.

After the inner detent 224 is released from engagement with the shoulder 304, the weight down collet 140 may be able to move to the fully supported position. This is shown in FIG. 4B. To achieve the fully supported position, the collet sleeve assembly 204 moves upwards with respect to the mandrel 202 and one or more lugs 406 (FIG. 4B) associated with the J-slot mechanism 206 may follow the J-slot profile 228 until an inner shoulder 408 of the collet sleeve assembly 204 engages an end wall 410 of the mandrel 202. In the fully supported position, the inner shoulder 408 engages the end wall 410 and the primary collet 210 may be radially supported by the mandrel 202, such as at an outer diameter feature 412 defined on the mandrel 202 (e.g., axially above the shoulder 304). As radially supported by the mandrel 202 at the outer diameter feature 412, the primary collet 210 may be unable to radially collapse or otherwise snap through the indicator coupling 402. As a result, the indicator coupling 402 is unable to bypass the primary collet 210 and the entire weight of the work string 120 (FIG. 1) may then be assumed by the service tool 138.

In the fully supported or "weight down" position, various downhole operations may be undertaken with the service tool 138. For instance, in the fully supported position, one or more packers (not shown) may be set within the wellbore 122 (FIG. 1) or a hydraulic fracturing and/or gravel packing job may be undertaken. In other embodiments, various downhole testing operations may be accomplished when the service tool 138 is in the fully supported position.

Following the various downhole operations that may be undertaken by the service tool 138 in the fully supported position, the service tool 138 may be moved out of the fully supported position and moved to another location within the completion string 128 or otherwise removed from the wellbore 122 (FIG. 1) altogether. To accomplish this, the service tool 138 may be pulled upwards or uphole (i.e., to the left in FIG. 4B) with respect to the completion string 128. Moving the service tool 138 upwards may cause the uphole end 218*b* of the lower detent 216*b* to engage the downhole end 404*b* of the indicator coupling 402, which results in an axial load applied on and moving the collet sleeve assembly 204 downhole (i.e., to the right in FIG. 4B) with respect to the mandrel 202.

The collet sleeve assembly 204 may continue to move downhole with respect to the mandrel 202 until the secondary collet 212 encounters the outer diameter feature 412 of the mandrel 202. More particularly, the downhole end 226*b* of the inner detent 224 may encounter and engage the outer diameter feature 412. As illustrated, the angled profile of the uphole end 218*b* of the lower detent 216*b* is steeper than the angled profile of the downhole end 226*b* of the inner detent 224. As a result, the snap value of the engagement between the uphole end 218*b* of the lower detent 216*b* and the downhole end 404*b* of the indicator coupling 402 may be greater than the engagement between the downhole end 226*b* of the inner detent 224 and the outer diameter feature 412. Accordingly, continued downhole movement of the collet sleeve assembly 204 with respect to the mandrel 202 may result in overcoming the snap value of the secondary collet 212, thereby allowing the secondary collet 212 to be pulled over the outer diameter feature 412.

Once the secondary collet 212 is pulled over the outer diameter feature 412, the weight down collet 140 may once again be in the unsupported or run position, such as is shown in FIG. 2. Moreover, moving the weight down collet 140 back to the unsupported position may also cycle the J-slot mechanism 206 once again such that the weight down collet 140 is again able to pass through restrictions while moving downhole. As a result, the weight down collet 140 may be moved downhole past the indicator coupling 402.

Referring again to FIG. 3, with continued reference to FIG. 4B, the weight down collet 140 may be moved out of the unsupported position by pulling in the upwards or uphole direction (i.e., to the left in FIG. 3) with respect to the completion string 128, as generally described above. In some embodiments, the weight down collet may be pulled in the uphole direction until the primary collet 210 encounters the seal bore 302. Once in the seal bore 302, the weight down collet 140 may then be moved back down in the downhole direction (i.e., to the right in FIG. 3) with respect to the completion string 128. In such cases, the secondary collet 212 may prove advantageous in holding the collet sleeve assembly 204 in the unsupported position against the shoulder 304 of the mandrel 202. More particularly, since the snap value of the secondary collet 212 as engaged on the shoulder 304 may be greater than the friction generated through engagement between the primary collet 210 and the seal bore 302, the collet sleeve assembly 204 remains in the unsupported position.

Embodiments disclosed herein include:

A. A weight down collet that includes a mandrel that provides an outer diameter feature and a shoulder, and a collet sleeve assembly movably disposed about the mandrel. The collet sleeve assembly includes a body, a primary collet provided on the body and defining an upper detent and a lower detent having a gap defined therebetween, wherein the upper and lower detents extend radially outward from the body and are engageable with one or more restrictions provided on an inner wall of a completion string, and a secondary collet provided on the body and axially spaced from the primary collet, wherein the secondary collet defines an inner detent that extends radially inward and is engageable with the shoulder, and wherein the collet sleeve assembly is movable between an unsupported position, where the primary collet is radially unsupported, and a supported position, where the primary collet is radially supported on the outer diameter feature.

B. A well system that includes a completion string arranged within a wellbore and having at least one seal bore and at least one indicator coupling provided on an inner wall of the completion string, a service tool extendable into the completion string, and a weight down collet included in the service tool and having a mandrel that provides an outer diameter feature and a shoulder, and a collet sleeve assembly movably disposed about the mandrel, the collet sleeve assembly including a body, a primary collet provided on the body and defining an upper detent and a lower detent having a gap defined therebetween, wherein the upper and lower detents extend radially outward from the body and are engageable with that at least one seal bore and the at least one indicator coupling, and a secondary collet provided on the body and axially spaced from the primary collet, wherein the secondary collet defines an inner detent that extends radially inward and is engageable with the shoulder, and wherein the collet sleeve assembly is movable between an unsupported position, where the primary collet is radially unsupported, and a supported position, where the primary collet is radially supported on the outer diameter feature.

C. A method that includes conveying a service tool into a wellbore having a completion string positioned therein, the completion string having at least one seal bore and at least one indicator coupling provided on an inner wall of the completion string, extending a service tool into the completion string in a downhole direction relative to the completion string, the service tool having a weight down collet that includes a mandrel and a collet sleeve assembly movably disposed about the mandrel, wherein the collet sleeve assembly includes a body, and a primary collet and a secondary collet provided on the body, engaging the primary collet on the at least one seal bore and thereby moving the collet sleeve assembly in an uphole direction relative to the mandrel, engaging the secondary collet on a shoulder defined on the mandrel and thereby stopping movement of the collet sleeve assembly in the uphole direction, engaging the primary collet on the at least one indicator coupling and thereby overcoming a snap value of the secondary collet as engaged on the shoulder, and moving the collet sleeve assembly to a supported position where the primary collet is radially supported on an outer diameter feature of the mandrel.

Each of embodiments A, B, and C may have one or more of the following additional elements in any combination: Element 1: wherein the one or more restrictions comprise a seal bore that is longer than the gap, and wherein engagement of the inner detent on the shoulder prevents the collet sleeve assembly from moving to the supported position when the primary collet engages the seal bore. Element 2: wherein, when the collet sleeve assembly moves in a downhole direction with respect to the completion string, the inner detent has a snap value that is greater than a friction force generated through engagement of the upper and lower detents on the seal bore. Element 3: wherein the one or more restrictions is an indicator coupling that is able to be located in the gap, and wherein engagement of the indicator coupling on the upper detent overcomes a snap value of the inner detent as engaged on the shoulder and thereby moves the collet sleeve assembly to the supported position. Element 4: wherein, when the collet sleeve assembly moves in a downhole direction with respect to the completion string, the upper and lower detents and the inner detent each have a corresponding snap value, and wherein the snap value of the upper detent is greater than the snap value of the inner detent, and the snap value of the inner detent is greater than the snap value of the lower detent.

Element 5: wherein the at least one seal bore is longer than the gap and engagement of the inner detent on the shoulder prevents the collet sleeve assembly from moving to the supported position when the primary collet engages the seal bore. Element 6: wherein, when the collet sleeve assembly moves in a downhole direction with respect to the completion string, the inner detent has a snap value greater than a friction force generated through engagement of the upper and lower detents on the at least one seal bore. Element 7: wherein the indicator coupling is sized to enter the gap and engagement of the at least one indicator coupling on the upper detent overcomes a snap value of the inner detent as engaged on the shoulder and thereby moves the collet sleeve assembly to the supported position. Element 8: wherein, when the collet sleeve assembly moves in a downhole direction with respect to the completion string, the upper and lower detents and the inner detent each have a corresponding snap value, and wherein the snap value of the upper detent is greater than the snap value of the inner detent, and the snap value of the inner detent is greater than the snap value of the lower detent.

Element 9: wherein the primary collet provides an upper detent and a lower detent, the upper and lower detents extending radially outward from the body, and wherein engaging the primary collet on the at least one seal bore comprises engaging the upper and lower detents on the at least one seal bore. Element 10: wherein the secondary collet provides an inner detent that extends radially inward and has a snap value when the service tool moves in the downhole direction with respect to the completion string, and wherein engaging the secondary collet on the shoulder comprises engaging the inner detent on the shoulder, and overcoming a friction force generated through engagement of the primary collet on the seal bore with the snap value of the secondary collet. Element 11: wherein the primary collet provides an upper detent, a lower detent, and a gap defined between the upper and lower detents, and wherein engaging the primary collet on the at least one indicator coupling comprises engaging the lower detent on the at least one indicator coupling, overcoming a snap value of the lower detent as engaged on the at least one indicator coupling with the snap value of the secondary collet as engaged on the shoulder, locating the at least one indicator coupling in the gap, and engaging the upper detent on the at least one indicator coupling. Element 12: further comprising undertaking one or more downhole operations with the service tool while the collet sleeve assembly is in the supported position. Element 13: further comprising moving the service tool in an uphole direction relative to the completion string and thereby moving the collet sleeve assembly in a downhole direction relative to the mandrel, engaging the secondary collet on the outer diameter feature, overcoming a snap value of the secondary collet as engaged on the outer diameter feature, and moving the collet sleeve assembly to an unsupported position where the primary collet is radially unsupported. Element 14: wherein the primary collet provides an upper detent, a lower detent, and a gap defined between the upper and lower detents, and wherein moving the service tool in the uphole direction comprises engaging the lower detent on the at least one indicator coupling. Element 15: further comprising moving the service tool in an uphole direction relative to the completion string and thereby moving the collet sleeve assembly in a downhole direction relative to the mandrel, engaging the secondary collet on the outer diameter feature, overcoming a first snap value of the secondary collet as engaged on the outer diameter feature via engagement of the at least one indicator coupling and the lower detent, engaging the primary collet on the at least one seal bore as the service tool is moved in the uphole direction, moving the service tool in the downhole direction relative to the completion string, and engaging the secondary collet on the shoulder and thereby preventing the weight down collet from moving back to the supported position. Element 16: wherein, when the service tool moves in the downhole direction with respect to the completion string, the secondary collet has a second snap value, the method further comprising overcoming a friction force generated through engagement of the primary collet on the seal bore with the second snap value of the secondary collet.

By way of non-limiting example, exemplary combinations applicable to A, B, C include: Element 1 with Element 2; Element 3 with Element 4; Element 5 with Element 6; Element 7 with Element 8; Element 13 with Element 14; and Element 15 with Element 16.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The use of directional terms such as above, below, upper, lower, upward, downward, left, right, uphole, downhole and the like are used in relation to the illustrative embodiments as they are depicted in the figures, the upward or uphole direction being toward the surface of the well and the downward or downhole direction being toward the toe of the well.

What is claimed is:

1. A weight down collet, comprising:

a mandrel that provides an outer diameter feature and a shoulder defined on the outer diameter feature; and a collet sleeve assembly movably disposed about the mandrel, the collet sleeve assembly including:

a body;

a primary collet provided on the body and defining an upper detent, a lower detent, and a gap defined therebetween, wherein the upper and lower detents extend radially outward from the body and are engageable with one or more restrictions provided on an inner wall of a completion string; and a secondary collet provided on the body and axially spaced from the primary collet, wherein the secondary collet defines an inner detent that extends radially inward and is engageable with the shoulder, and wherein the collet sleeve assembly is movable between an unsupported position, where the primary collet is radially unsupported, and a supported position, where the primary collet is radially supported on the outer diameter feature.

2. The weight down collet of claim 1, wherein the one or more restrictions comprise a seal bore that is longer than the gap, and wherein engagement of the inner detent on the shoulder prevents the collet sleeve assembly from moving to the supported position when the primary collet engages the seal bore.

3. The weight down collet of claim 2, wherein, when the collet sleeve assembly moves in a downhole direction with respect to the completion string, the inner detent has a snap value that is greater than a friction force generated through engagement of the upper and lower detents on the seal bore.

4. The weight down collet of claim 1, wherein the one or more restrictions is an indicator coupling that is able to be located in the gap, and wherein a snap value of the upper detent as engaged on the indicator coupling is greater than a snap value of the inner detent as engaged on the shoulder, whereby the collet sleeve assembly is able to move to the supported position.

5. The weight down collet of claim 4, wherein, when the collet sleeve assembly moves in a downhole direction with respect to the completion string, the upper and lower detents and the inner detent each have a corresponding snap value, and wherein the snap value of the inner detent is greater than the snap value of the lower detent.

6. A well system, comprising:

a completion string arranged within a wellbore and having at least one seal bore and at least one indicator coupling provided on an inner wall of the completion string;

a service tool extendable into the completion string; and a weight down collet coupled to the service tool and having a mandrel that provides an outer diameter feature, a shoulder defined on the outer diameter feature, and a collet sleeve assembly movably disposed about the mandrel, the collet sleeve assembly including:

a body;

a primary collet provided on the body and defining an upper detent, a lower detent, and a gap defined therebetween, wherein the upper and lower detents extend radially outward from the body and are engageable with the at least one seal bore and the at least one indicator coupling; and a secondary collet provided on the body and axially spaced from the primary collet, wherein the secondary collet defines an inner detent that extends radially inward and is engageable with the shoulder, and wherein the collet sleeve assembly is movable between an unsupported position, where the primary collet is radially unsupported, and a supported position, where the primary collet is radially supported on the outer diameter feature.

7. The well system of claim 6, wherein the at least one seal bore is longer than the gap and engagement of the inner detent on the shoulder prevents the collet sleeve assembly from moving to the supported position when the primary collet engages the seal bore.

8. The well system of claim 7, wherein, when the collet sleeve assembly moves in a downhole direction with respect to the completion string, the inner detent has a snap value greater than a friction force generated through engagement of the upper and lower detents on the at least one seal bore.

9. The well system of claim 6, wherein the indicator coupling is sized to enter the gap and a snap value of the upper detent as engaged on the indicator coupling is greater than a snap value of the inner detent as engaged on the shoulder, whereby the collet sleeve assembly is able to move to the supported position.

10. The well system of claim 9, wherein, when the collet sleeve assembly moves in a downhole direction with respect to the completion string, the upper and lower detents and the inner detent each have a corresponding snap value, and wherein the snap value of the upper detent is greater than the snap value of the inner detent, and the snap value of the inner detent is greater than the snap value of the lower detent.

11. A method, comprising:

conveying a service tool into a wellbore having a completion string positioned therein, the completion string having at least one seal bore and at least one indicator coupling provided on an inner wall of the completion string;

extending a service tool into the completion string in a downhole direction relative to the completion string, the service tool having a weight down collet that includes a mandrel and a collet sleeve assembly movably disposed about the mandrel, wherein the collet sleeve assembly includes a body, and a primary collet, and a secondary collet provided on the body;

engaging the primary collet on the at least one seal bore and thereby moving the collet sleeve assembly in an uphole direction relative to the mandrel;

engaging the secondary collet on a shoulder defined on the mandrel and thereby stopping movement of the collet sleeve assembly in the uphole direction relative to the mandrel;

engaging the primary collet on the at least one indicator coupling and overcoming a snap value of the secondary collet as engaged on the shoulder as the service tool continues to move in the downhole direction relative to the completion string; and moving the collet sleeve assembly to a supported position where the primary collet is radially supported on an outer diameter feature of the mandrel.

12. The method of claim 11, wherein the primary collet provides an upper detent and a lower detent, the upper and lower detents extending radially outward from the body, and wherein engaging the primary collet on the at least one seal bore comprises engaging the upper and lower detents on the at least one seal bore.

13. The method of claim 11, wherein the secondary collet provides an inner detent that extends radially inward and exhibits a snap value when the service tool moves in the downhole direction with respect to the completion string, and wherein engaging the secondary collet on the shoulder comprises:

engaging the inner detent on the shoulder, wherein the snap value of the secondary collet is greater than a friction force generated through engagement of the primary collet on the seal bore; and overcoming the friction force as the service tool moves in the downhole direction with respect to the completion string.

14. The method of claim 11, wherein the primary collet provides an upper detent, a lower detent, and a gap defined between the upper and lower detents, and wherein engaging the primary collet on the at least one indicator coupling comprises:

engaging the lower detent on the at least one indicator coupling, the lower detent exhibiting a snap value as engaged on the at least one indicator coupling, wherein the snap value of the secondary collet as engaged on the shoulder is greater than the snap value of the lower detent as engaged on the at least one indicator coupling;

overcoming the snap value of the lower detent as the service tool moves in the downhole direction with respect to the completion string;

locating the at least one indicator coupling in the gap; and engaging the upper detent on the at least one indicator coupling.

15. The method of claim 11, further comprising undertaking one or more downhole operations with the service tool while the collet sleeve assembly is in the supported position, the one or more downhole operations being selected from the group consisting of setting one or more packers within the wellbore, a hydraulic fracturing operation, a gravel packing operation, a downhole testing operation, and any combination thereof.

16. The method of claim 11, further comprising:

moving the service tool in an uphole direction relative to the completion string and thereby moving the collet sleeve assembly in a downhole direction relative to the mandrel;

engaging the secondary collet on the outer diameter feature, the secondary collet exhibiting a snap value as engaged on the outer diameter feature;

overcoming the snap value of the secondary collet as engaged on the outer diameter feature as the service tool moves in the uphole direction relative to the completion string; and moving the collet sleeve assembly to an unsupported position where the primary collet is radially unsupported.

17. The method of claim 16, wherein the primary collet provides an upper detent, a lower detent, and a gap defined between the upper and lower detents, and wherein moving the service tool in the uphole direction comprises engaging the lower detent on the at least one indicator coupling.

18. The method of claim 11, further comprising:

moving the service tool in an uphole direction relative to the completion string and thereby moving the collet sleeve assembly in a downhole direction relative to the mandrel;

engaging the secondary collet on the outer diameter feature, the secondary collet exhibiting a first snap value as engaged on the outer diameter feature that is greater than a snap value of the lower detent as engaged on the at least one indicator coupling;

overcoming the first snap value of the secondary collet as the service tool moves in the uphole direction relative to the completion string;

engaging the primary collet on the at least one seal bore as the service tool is moved in the uphole direction;

moving the service tool in the downhole direction relative to the completion string; and engaging the secondary collet on the shoulder and thereby preventing the weight down collet from moving back to the supported position.

19. The method of claim 18, wherein, when the service tool moves in the downhole direction with respect to the completion string, the secondary collet exhibits a second snap value that is greater than a friction force generated through engagement of the primary collet on the seal bore, the method further comprising overcoming the friction force generated through engagement of the primary collet on the seal bore as the service tool moves in the downhole direction with respect to the completion string.

* * * * *